United States Patent [19]

Ohsugi et al.

[11] Patent Number: 4,955,213

[45] Date of Patent: Sep. 11, 1990

[54] FULL AUTOMATIC ELECTRIC WASHING MACHINE HAVING AN AUTO-OFF POWER SOURCE STRUCTURE

[75] Inventors: Hiroshi Ohsugi; Hiroyuki Toshimitsu; Toshiyasu Kamano, all of Hitachi; Tamotu Shikamori, Juou; Masayoshi Hirayama, Hitachi, all of Japan

[73] Assignee: Hitachi, Ltd., Tokyo, Japan

[21] Appl. No.: 309,356

[22] Filed: Feb. 13, 1989

[30] Foreign Application Priority Data

Feb. 19, 1988 [JP] Japan ..... 63-35266

[51] Int. Cl.[5] ..... D06F 33/02

[52] U.S. Cl. ..... 68/12 R; 364/478; 340/618

[58] Field of Search ..... 68/12 R; 364/478; 340/618; 134/113

[56] References Cited

U.S. PATENT DOCUMENTS

| | | | |
|---|---|---|---|
| 3,091,953 | 1/1963 | Hubbard | 68/12 R |
| 3,226,959 | 1/1966 | Smith et al. | 68/12 R |
| 3,986,372 | 10/1976 | Karklys | 68/12 R |
| 4,195,500 | 4/1980 | Tobita et al. | 68/12 R |
| 4,208,890 | 6/1980 | Wood | 68/12 R |
| 4,676,077 | 6/1987 | Hirouka et al. | 68/12 R |

FOREIGN PATENT DOCUMENTS

| | | | |
|---|---|---|---|
| 61-41596 | 9/1980 | Japan | 68/12 R |
| 60-119990 | 6/1985 | Japan | 68/12 R |
| 62-299294 | 12/1987 | Japan | 68/12 R |

*Primary Examiner*—Frankie L. Stinson

*Attorney, Agent, or Firm*—Antonelli, Terry, Stout & Kraus

[57] ABSTRACT

When an abnormal washing condition occurs during a washing process, an auto-off power source switch is made automatically to present an off condition after a long shelf time such as one hour. In case of the abnormal washing condition of the washing process, since the switch maintains the long shelf time, an operator can notice such an abnormal condition during this long shelf time and then remaining normal washing process can be carried out continuously by getting rid of the abnormal cause. It is therefore unnecessary to re-set the washing process. After the washing process has been finished, the switch is made automatically to present the off condition at a short shelf time such as five minutes. During this short shelf time, it is unnecessary to start the switch at an on condition so as to re-start for carrying out next washing process.

25 Claims, 3 Drawing Sheets

FULL AUTOMATIC ELECTRIC WASHING MACHINE HAVING AN AUTO-OFF POWER SOURCE STRUCTURE

BACKGROUND OF THE INVENTION

The present invention relates to a full automatic electric washing machine having an auto-off power source structure and, more particularly to a full automatic electric washing machine having an auto-off power source structure in which, after a series of washing processes finish, an auto-off power source switch provided on a panel control portion of a main body of the full automatic electric washing machine automatically presents an off condition.

A conventional full automatic electric washing machine is disclosed in, for example Japanese Patent Laid-Open No. 48789/1985 in which the full automatic electric washing machine is constructed so that after a series of washing processes has been finished, an auto-off power source switch provided on a panel control portion of a main body of the full automatic electric washing machine automatically presents an off condition.

Namely, in the above stated conventional full automatic electric washing machine, a delay means is provided in a main body of the full automatic electric washing machine so as to maintain a power source control circuit for controlling the auto-off power source switch at a closed state with a predetermined delay time, after a series of washing processes has been finished. Thereby the auto-off power source switch is made automatically to present the off condition with a predetermined delay time such as five seconds.

In the above stated conventional full automatic electric washing machine, when a series of washing processes has been finished completely, a washing finish announcing buzzer, which informs of the finish of a series of washing processes, sounds for five seconds. Then the auto-off power source switch is made to automatically present an off condition with a lapse of five seconds.

When an operator goes to the side of the full automatic electric washing machine, the auto-off power source switch has already been automatically set to the off condition. Even when the next washing process is the same washing process of the previous washing process, it is necessary to re-set the same washing process for the full automatic electric washing machine by the operator. However, the set for the same washing process by pushing a button or buttons of a panel control portion of the main body can be troublesome to the operator.

If an abnormal washing condition occurs during a middle of the washing process in the full automatic electric washing machine, the auto-off power source switch is made automatically to present the off condition after the lapse as in the same time of the case of the finish a series of washing processes, namely at five seconds. In order to carry out the next follow washing process, it is necessary to re-set such a next follow washing process by pushing the button or buttons of the panel control portion.

SUMMARY OF THE INVENTION

An object of the present invention is to provide a full automatic electric washing machine having an auto-off power source structure wherein even at an abnormal washing condition during a middle of the washing process, an auto-off power source switch can be made automatically to present an off condition with a comparatively long shelf time.

Another object of the present invention is to provide a full automatic electric washing machine having an auto-off power source structure wherein after the normal washing process or a series of washing processes has been finished, an auto-off power source switch can be made to automatically present an off condition with a short shelf time.

A further object of the present invention is to provide a full automatic electric washing machine having an auto-off power source structure wherein after the normal washing process or a series of washing processes has been finished, it is unnecessary to re-set the washing operation program in case that the next washing process is the same the previous washing process.

Another object of the present invention is to provide a full automatic electric washing machine having an auto-off power source structure wherein even at an abnormal washing condition during a middle of the washing process, the remaining normal washing process can be carried out continuously without a re-set of the washing operation program.

Another object of the present invention is to provide a full automatic electric washing machine having an auto-off power source structure wherein in case of a mechanical lock or an electrical breakage in the wire in an electrical means for an auto-off power source switch, a chance for presenting an off condition of the auto-off power source switch can be increased.

In accordance with the present invention, a full automatic electric washing machine having an auto-off power source structure comprising an auto-off power source switch being provided on a panel control portion of a main body of a full automatic electric washing machine, when a washing process has been finished, the auto-off power source switch is made automatically to present an off condition.

When an abnormal washing condition takes place during a middle of the washing process, the auto-off power source switch is made automatically to present an off condition at a comparative long shelf time.

After the normal washing process or a series of washing processes has been finished, the auto-off power source switch is made automatically to present the off condition at a comparatively short shelf time.

In accordance with the present invention, a comparatively long shelf time in the abnormal washing condition during a middle of the washing process is set at a longer time than the longest washing cycle time. After the normal washing process or a series of washing processes has been finished, a comparatively short shelf time is set at a shorter time than the shortest washing cycle time.

According to the present invention, after the normal washing process or a series of washing processes has been finished, since the auto-off power source switch is made automatically to present the off condition at a comparatively short shelf time, during this comparatively short shelf time, it unnecessary to start the auto-off power source switch at the on condition so as to re-start for carrying out the next washing process for the full automatic electric washing machine.

The washing process of the re-start for the next washing process is selected by pushing a button or buttons on the first outside operation portion or the second outside operation portion on the panel control portion. Therefore, a facility operation for the full automatic electric washing machine can be improved effectively.

Further, in case of the abnormal washing condition during a middle of the washing process, since the auto-off power source switch maintains a comparatively long shelf time so as to automatically present the off condition, during this comparatively long shelf time, the operator can notice an abnormal washing condition during a middle of the washing process and then the remaining normal washing process or a series of washing process can be carried out continuously by getting rid of the abnormal cause.

Therefore, it is unnecessary to re-set the next follow washing operation program and a facility operation for the full automatic electric washing machine can be improved effectively.

Further, since repetition of the operation time for the washing process can be eliminated, merits for shorter washing process time, economy in supply water and economy in detergent can be attained effectively.

DESCRIPTION OF THE INVENTION

One embodiment of a full automatic electric washing machine having an auto-off power source structure according to the present invention will be explained referring to drawings.

Figure 1:
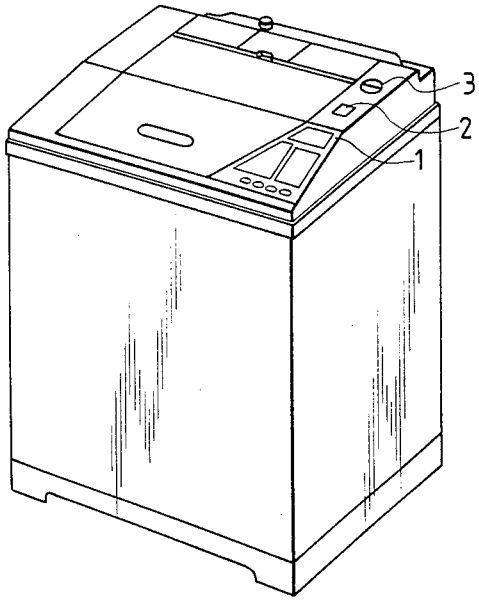
FIG. 1 is an outside appearance showing one embodiment of a full automatic electric washing machine according to the present invention.

FIG. 1 is an outside appearance of a full automatic electric washing machine in which the present invention is adopted. The full automatic electric washing machine comprises a main body having a panel control portion 1 thereon. The panel control portion 1 is provided on an upper right portion of the main body.

Figure 2:
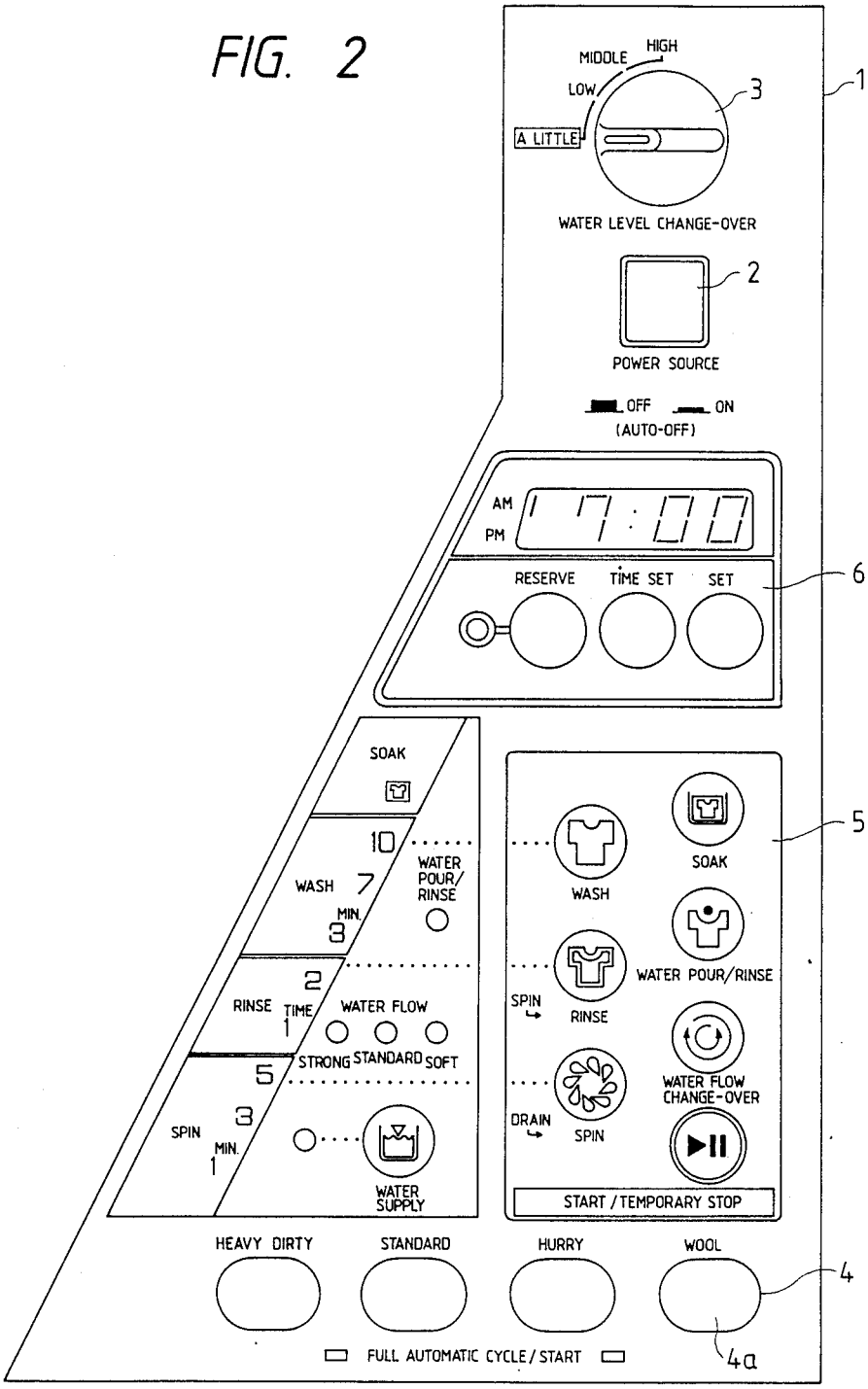
FIG. 2 is an enlarged view showing a panel control portion of the main body of the full automatic electric washing machine according to one embodiment of the present invention.
Figure 4:
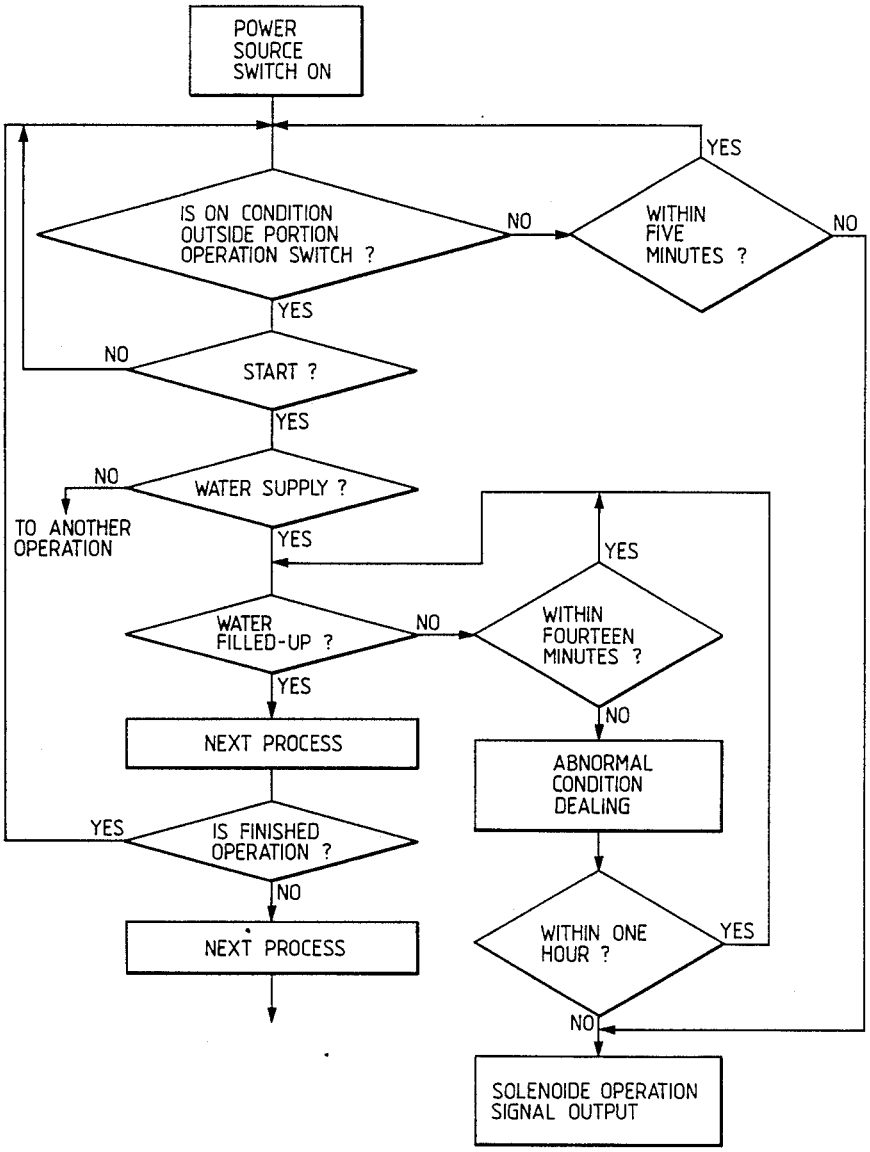
FIG. 4 is a flow-chart showing an automatic off condition of a power source switch of the full automatic electric washing machine according to one embodiment of the present invention.

As shown in FIG. 2, in the panel control portion 1 mounted on the main body, an auto-off power source switch 2 for switching a main power source, a water level changeover knob 3, a first outside operation portion 4, a second outside operation portion 5, and a time display portion 6 are provided, respectively.

The auto-off power source switch 2 operates the main power source of the full automatic electric washing machine at an on condition or at an off condition by pushing the auto-off power source switch 2. The water level change-over knob 3 is connected to a pressure switch and is changed by an operator. The pressure switch is mounted in the main body and detects a water level in a washing tub.

The first outside operation portion 4 comprises four kinds of buttons. Each of the buttons of the first outside operation portion 4 indicates respectively a state of a full automatic washing cycle comprising heavy dirty, standard, hurry, and wool washing cycles as shown in FIG. 2 and one of the buttons is selected by the operator.

The second outside operation portion 5 includes a soak button, a water pour/rinsing button, a water flow change-over button, three kinds of buttons for operating washing, rinsing, and spinning, a start/temporary stop button, and a water supply button.

The time display portion 6 displays a present time, a reservation time, or remainder time. At a lower portion of the time display portion 6, a reservation button, a time set button for setting a present time, and a set button are provided.

Figure 3:
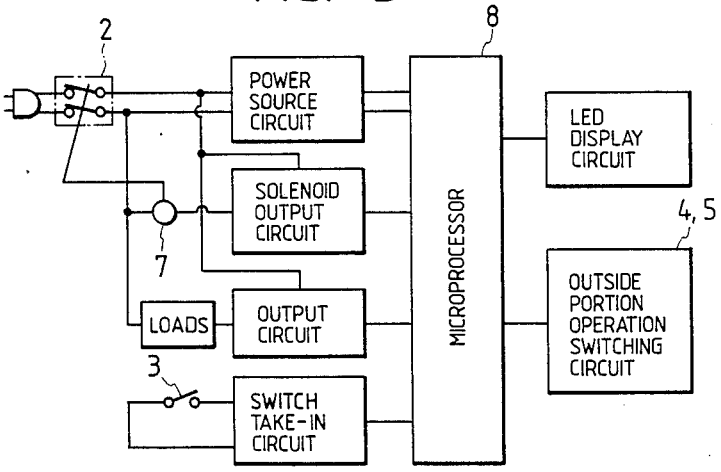
FIG. 3 is an electric control block diagram showing an electric connection relationship of various control circuits to a micro-processor according to one embodiment of the present invention.

In FIG. 3, an electrical output circuit works to obtain an electrical output signal for driving of loads of the full automatic electric washing machine such as a motor, a water inlet valve, a drain valve or the like. A switch signal take-in electrical circuit works to obtain various kinds of switch electrical signals from the pressure switch, a lid switch for indicating an open or close state of a lid of a spinning basket or the like.

Next, one example washing operation of a washing process carried out in the full automatic electric washing machine according to one embodiment of the present invention will be explained as follows.

After an operator puts the wash into the washing tub of the full automatic electric washing machine, the operator sets a desired water level by the water level change-over knob 3. When the water level change-over knob 3 is selected and adjusted to obtain a suitable water level (for example, "a little" water level) by the operator, the operator pushes a button of the auto-off power source switch 2 so as to turn the auto-off power source switch 2 at an on condition.

Then the main power source presents the on condition and electric power through the auto-off power source switch 2 is supplied to a micro-processor 8. Therefore the full automatic electric washing machine is made to present an operable condition for carrying out an established washing process.

In this washing process, when the operator pushes a button 4*a* for a wool washing or a soft washing of the first outside operation portion 4, the washing process of the full automatic electric washing machine is set washing (three minutes), rinsing (one time), and spinning (one minute). The washing process comprising washing (stirring), rinsing, and spinning is carried out automatically in the full automatic electric washing machine, respectively.

In this washing process, when the operator forgets to open the faucet of city water, the full automatic electric washing machine remains in this condition and no water is supplied into the washing tub. Therefore the pressure switch, which detects the water level in the washing tub, is not changed over to present a water filled-up state in the washing tub.

A contact of the pressure switch is normally changed over from an open contact condition at a no water state in the washing tub to a closed contact condition at the water filled-up state in the washing tub. The pressure switch detects pressure due to the water level in the washing tub and is changed over through a diaphragm member mounted on the pressure switch.

In this case, an electrical signal for informing a water filled-up state is not sent to the micro-processor 8. When the water filled-up state informing electrical signal is not sent to the micro-processor 8, after a lapse of fourteen minutes, for example, then there is judged to be present a water supply abnormal condition during a middle of the washing process by the micro-processor 8.

Then three LED's (ten minutes display, seven minutes display, three minutes display) for displaying the washing time provided on the second outside operation portion 5 are turned on and off, thereby providing an indication of such a water supply abnormal condition during a middle of the washing process.

In this embodiment of the present invention, after a lapse of fourteen minutes from the start for water supply into the washing tub, when the contact for indicating the water filled-up state of the pressure switch is not closed, it is judged by the micro-processor 8 as an abnormal condition during of a middle of the washing process.

Namely, such a water supply abnormal condition is programmed in advance as one element factor in the microprocessor 8 so as to inform or announce the water supply abnormal condition during of a middle of the washing process, in case of after a lapse of fourteen minutes from the start for water supply into the washing tub, and further the water filled-up state informing electrical signal is not sent to the micro-processor 8 through the detection by the pressure switch.

After that, when one hour lapses, for example, and no electrical signal is sent to the micro-processor 8, and the operator does not operate the full automatic electric washing machine so as to remedy the water supply abnormal condition during a middle of the washing process, the auto-off power source switch 2 is made to automatically present an off condition under the control of the micro-processor 8.

Three LED's of the second outside operation portion 5 continue automatically turning the lights on and off and cease turning the lights on and off when the auto-off power source switch 2 is made automatically to present the off condition. The auto-off power source switch 2 is made automatically to present the off condition by sending an electrical signal for operating a solenoid 7 for two seconds, for example.

The solenoid 7 works so as to automatically present the off condition of the auto-off power source switch 2. A relay member which corresponds to one kind of a switch using a solenoid can also be adopted in the present invention.

However in this embodiment of the present invention, in case of the occurrence of the water supply abnormal condition during a middle of the washing process, as described above the operator can notice such an abnormal condition during the washing process since the auto-off power source switch 2 presents the on condition due for a comparatively long shelf time (one hour). Then the operator can get rid of the abnormal cause and the remaining normal washing process can be carried out continuously.

A after the occurrence of the above stated water supply abnormal condition during a middle of the washing process, and when the auto-off power source switch 2 is made automatically to present the off condition, then the operator must to re-set the washing process.

When each washing process goes ahead smoothly and all normal washing processes have been finished, and no electrical signal is sent to the micro-processor 8 through the operator's operation in the first outside operation portion 4 or the second outside operation portion 5 provided on the panel control portion 1 within five minutes, for example, the electrical signal for operating the solenoid 7 is sent to the micro-processor 8 for two seconds and makes automatically to present the auto-off power source switch 2 at the off condition.

In this case, since after a lapse of about five minutes from the finish of all washing processes, the auto-off power source switch 2 is made automatically to present the off condition.

Accordingly, the operator can re-set the next follow washing process without trouble, when the next washing process is the same washing process as the previous washing process.

In this embodiment of the present invention, when the abnormal washing condition is taken during a middle of the washing process, a comparatively long shelf time for making automatically the auto-off power source switch 2 so as to present the off condition is set to one hour. However, such a comparative long shelf time may be set from about forty minutes to about three hours.

Further in this embodiment of the present invention, after the washing process has been finished, a comparative short shelf time for making automatically the auto-off power source switch 2 so as to present the off condition is set for five minutes. However, such a comparative short shelf time may be set from about one minute to about ten minutes.

When the auto-off power source switch 2 sends an operation signal for presenting the off condition to the solenoid 7 for two seconds, a mechanical lock and an electrical breakage in the wire or the like in the solenoid 7 occur and the auto-off power source switch 2 is not made automatically to present the off condition.

Then the operator can make the auto-off power source switch 2 to present the off condition. However the operation signal for the solenoid 7 is continued to send for two seconds at every five minutes until an electrical signal reaches the first outside operation portion 4 or the second outside operation portion 5 provided on the panel control portion 1.

Therefore, in case of mechanical lock or the electrical breakage in the wire in the solenoid 7, a chance for presenting the off condition of the auto-off power source switch 2 increases and a safety of the full automatic electric washing machine is improved effectively.

Because the current supply to the solenoid 7 has a short time, a temperature rise in the solenoid 7 is not generated and accordingly the solenoid 7 can be made inexpensive and powerful. Therefore, reliability in the solenoid 7 can be improved.

In this embodiment of the present invention, the water supply abnormal condition is taken as one of the abnormal washing condition during a middle of the washing process. However the abnormal washing condition during a middle of the washing process is caused by in case of the situation that a lid, which is installed at an upper portion of the spinning basket of the main body, is opened during the spinning operation, the situation that an unbalance switch for detecting the abnormal vibration of the spinning basket is operated during the spinning operation, the situation that an excess time for draining water in the washing tub, for example more than five minutes for draining water in the washing tub, is required during the rinsing operation, or the like.

In case of the abnormal washing condition during a middle of the spinning operation, three LED's (five minutes display, three minutes display, one minute display) for displaying a spinning provided on the second outside operation portion 5 are turned lights on and off, thereby such a spinning abnormal condition during a middle of the washing process of the full automatic electric washing machine is displayed visibly.

In case of the abnormal washing condition during a middle of the rinsing operation, two LED's (two times, one time) for displaying a number of the rinsing time provided on the second outside operation portion 5 are turned lights on and off, thereby such a rinsing abnormal condition during a middle of the washing process of the full automatic electric washing machine is displayed visibly.

In this embodiment of the present invention, a comparative long shelf time for the abnormal washing condition during the washing process is set at a longer time than the longest washing cycle time. In the above stated embodiment of the present invention, the longest washing cycle time (twenty seven minutes) is the heavy dirty washing cycle or the strong washing cycle comprising washing time (ten minutes), two times rinsing time (twelve minutes), and spinning time (five minutes).

In this embodiment of the present invention, after the normal washing process or a series of washing processes is finished, a comparatively short shelf time is set at a shorter time than the shortest washing cycle time. In the above stated embodiment of the present invention, the shortest washing cycle time (ten minutes) is the wool washing cycle or the soft washing cycle comprising washing time (three minutes), one time rinsing time (six minutes), and spinning time (one minute).

We claim:

1. A full automatic electric washing machine having an auto-off power source structure comprising an auto-off power source switch provided on a panel control portion of a main body of said full automatic electric washing machine, said auto-off power source switch automatically presenting an off condition after a washing process has been finished, said washing machine further including means for controlling said auto-off power switch such that when an abnormal washing condition occurs during said washing process, said auto-off power source switch is controlled to present an off condition after a predetermined shelf time.

2. A full automatic electric washing machine having an auto-off power source structure according to claim 1, the washing process comprising at least one of a shortest washing cycle time and a longest washing cycle time, wherein said predetermined shelf time is set greater than the longest washing cycle time.

3. A full automatic washing machine according to claim 1, wherein said predetermined shelf time has a predetermined relationship to a washing cycle time.

4. A full automatic electric washing machine having an auto-off power source structure comprising an auto-off power source switch provided on a panel control portion of a main body of said full automatic electric washing machine, said auto-off power source switch automatically presenting an off condition after a washing process has been finished, said washing machine further including means for controlling said auto-off power switch such that when an abnormal washing condition occurs during said washing process, said auto-off power source switch is controlled to present the off condition after a first predetermined shelf time, and further after said washing process has been finished said auto-off power source switch is controlled to present the off condition after a second predetermined shelf time.

5. A full automatic electric washing machine having an auto-off power source structure according to claim 4, the washing process comprising at least one of a shortest washing cycle time and a longest washing cycle time wherein said first predetermined shelf time is set to be greater than the longest washing cycle time, and further said second predetermined shelf time after the washing process has been finished is set to be less than the shortest washing cycle time.

6. A full automatic washing machine according to claim 4, wherein said first and second predetermined shelf times have respective first and second predetermined relationships to at least one washing cycle time.

7. A full automatic electric washing machine having a power source provided on a panel control portion of a main body of a full automatic electric washing machine, when a washing process has been finished, said power source is made automatically to present an off condition, the washing process comprising at least the shortest washing cycle time and the longest washing cycle time, and after said power source is made automatically to present the off condition the full automatic electric washing machine is left with no operation characterized in that when after the washing process has been finished the full automatic electric washing machine is left as it is, said power source is made automatically to present the off condition at a shorter shelf time than the shortest cycle time, and when an abnormal washing condition occurs during a middle of the washing process and the washing process is made to stop, and said power source is made automatically to present the off condition at a longer shelf time than the longest cycle time.

8. A full automatic electric washing machine having a power source according to claim 7, characterized in that when the abnormal washing condition occurs during a middle of the washing process, said power source is made automatically to present the off condition from about forty minutes to about three hours.

9. A full automatic electric washing machine having a power source according to claim 7, characterized in that after the washing process is finished, said power source is made automatically to present the off condition from about one minute to about ten minutes.

10. A full automatic electric washing machine having a power source according to claim 7, characterized in that said the shortest cycle time is soft washing cycle.

11. A full automatic electric washing machine having a power source according to claim 7, characterized in that said the longest cycle time is heavy dirty washing cycle.

12. A full automatic electric washing machine having an auto-off power source structure comprising an auto-off power source switch provided on a panel control portion of a main body of said full automatic electric washing machine, means for controlling said auto-off power source switch, a first outside operation portion comprising buttons for indicating a plurality of full automatic washing cycles, and a second outside operation portion comprising buttons for indicating a plurality of washings and for displaying degrees of said plurality of washings, when a washing process has been finished, said means for controlling controls said auto-off power source switch to present the off condition, wherein said means for controlling further controls said auto-off power switch such that when an abnormal washing condition occurs during said washing process, said second outside operation portion displays an indication of the abnormal washing condition and said auto-off power source switch is controlled to present the off condition after a predetermined shelf time.

13. A full automatic electric washing machine having an auto-off power source switch according to claim 12, wherein said abnormal washing condition is selected from at least one of a no water supply state in a washing tub during the washing process, an opened lid state of a spinning basket during spinning process, an operation of an unbalance switch during the spinning process, and an excess time situation for draining water in a washing tub.

14. A full automatic electric washing machine having an auto-off power source switch according to claim 12, wherein when said abnormal washing condition is corrected while said auto-off power source switch presents an on condition, a remaining normal washing process is carried out.

15. A full automatic electric washing machine having an auto-off power source switch according to claim 12, wherein when at least one of a mechanical lock and an electric breakage in a wire in said means for controlling said auto-off power source switch occurs, said auto-off power source switch does not present the off condition.

16. A full automatic electric washing machine having an auto-off power source switch according to claim 10, wherein an electric operation signal for said means for controlling said auto-off power source switch is continuously produced until an electrical signal from at least one of said first outside operation portion and said second outside operation portion reaches said means for controlling said auto-off power source switch.

17. A full automatic washing machine according to claim 16, wherein said predetermined shelf time has a predetermined relationship to a washing cycle time.

18. A full automatic electric washing machine having an auto-off power source structure comprising an auto-off power source switch provided on a panel control portion of a main body of said full automatic electric washing machine, means for controlling said auto-off power source switch, a first outside operation portion comprising buttons for indicating a plurality of full automatic cycles, and a second outside operation portion comprising buttons for indicating a plurality of washings and for displaying degrees of said plurality of washings, wherein when a washing process has been finished, said means for controlling controls said auto-off power source switch to present the off-condition, wherein said means for controlling further controls said auto-off power switch such that when an abnormal washing condition occurs during said washing process, said second outside operation portion displays the abnormal washing condition and said auto-off power source switch is controlled to present an off condition after a first predetermined shelf time, and further after the washing process has been finished said auto-off power source switch is controlled to present the off condition after a second predetermined shelf time.

19. A full automatic electric washing machine having an auto-off power source switch according to claim 18, wherein said abnormal washing condition is selected from at least one of a no water supply state in a washing tub during the washing process, an opened lid state of a spinning basket during spinning process, an operation of an unbalance switch during the spinning process, and an excess time situation for draining water in a washing tub.

20. A full automatic electric washing machine having an auto-off power source switch according to claim 18, wherein when said abnormal washing condition is while said auto-off power source switch presents an on condition, a remaining normal washing process is carried out continuously.

21. A full automatic electric washing machine having a power source according to claim 18, wherein said first determined shelf time is set to be not less than forty minutes and not more than three hours.

22. A full automatic electric washing machine having a power source according to claim 18, wherein said second predetermined shelf time is set to be not less than one minute and not more than ten minutes.

23. A full automatic electric washing machine having an auto-off power source switch according to claim 18, wherein when at least one of a mechanical lock and an electric breakage in a wire in said means for controlling said auto-off power source switch occurs, said auto-off power source switch does not present the off condition.

24. A full automatic electric washing machine having an auto-off power source switch according to claim 18, wherein an electric operation signal for said means for controlling said auto-off power source switch is continuously produced until an electrical signal from at least one of said first outside operation portion and said second outside operation portion reaches said means for controlling said auto-off power source switch.

25. A full automatic washing machine according to claim 18, wherein said first and second predetermined shelf times have respective first and second predetermined relationships to at least one washing cycle time.

* * * * *